United States Patent [19]

Leanna et al.

[11] 4,266,735

[45] May 12, 1981

[54] MANDREL SUPPORTS FOR AUTOMATIC WEB REWINDER

[75] Inventors: Dale D. Leanna, Little Suamico; Allen R. Jorgensen, Abrams, both of Wis.

[73] Assignee: Magna-Graphics Corporation, Oconto Falls, Wis.

[21] Appl. No.: 119,962

[22] Filed: Feb. 8, 1980

[51] Int. Cl.[3] ..... B65H 19/20; B65H 75/34

[52] U.S. Cl. ..... 242/56 A; 242/64

[58] Field of Search ..... 242/56 R, 56 A, 67.1 R, 242/67.2, 67.3, 64

[56] References Cited

U.S. PATENT DOCUMENTS

| | | | |
|---|---|---|---|
| 2,585,226 | 2/1952 | Christman | 242/56.6 |
| 2,769,600 | 11/1956 | Kwitek | 242/64 X |
| 2,995,314 | 8/1961 | Nystrand | 242/64 |
| 3,179,348 | 4/1965 | Nystrand | 242/56 A |
| 3,547,365 | 12/1970 | Loose | 242/56 A |
| 3,930,620 | 1/1976 | Taitel | 242/56 A |
| 4,208,019 | 6/1980 | Dusenberg | 242/56 A |

*Primary Examiner*—Edward J. McCarthy
*Attorney, Agent, or Firm*—James E. Nilles

[57] ABSTRACT

In an automatic web rewinding machine having core supporting mandrels carried by an indexingly rotated turret, the chuck arm for supporting the free end of each mandrel is swung between a closed mandrel engaging position and an open position by a reversible pneumatic rotary actuator controlled by a two-position valve. Each actuator and its valve are constrained to rotate with the turret, and they receive pressure air through a hollow turret shaft. A cam follower plunger of the valve is biased to an extended condition at which the actuator tends to hold the chuck arm closed. When a mandrel is established at the unloading station at which wound cores are removed from it, a signal from a turret position sensor causes extension of a first movable cam segment at said station, retracting the plunger and thus opening the chuck arm. As the turret carries the mandrel to the core loading station the valve plunger engages a fixed cam segment, and then an extended second movable cam segment at the loading station, to keep the chuck arm open. A condition for retraction of the second movable cam segment, to effect chuck arm closing, is issuance by a core detector of an output signifying proper loading of a core onto the mandrel. A core loading wheel moves into engagement with the mandrel when it arrives at the loading station, to damp vibration of its free end, and also serves for loading a core onto the mandrel.

10 Claims, 8 Drawing Figures

5
6
25
8
43b
43a
28
22
23
18
51
52
4

MANDREL SUPPORTS FOR AUTOMATIC WEB REWINDER

FIELD OF THE INVENTION

This invention relates to automatic web rewinding machines whereby paper towel stock, toilet paper stock or the like, unwound from a very large parent roll, is rewound into small individual rolls. In such machines, the individual rolls are wound onto tubular cores, each of which is supported on a rotating mandrel. The mandrel must have a cantilevered mounting so that cores can be axially loaded onto it and wound rolls can be axially stripped off of it, but it must have its free end supported during winding. In particular, the invention relates to automatic means for swinging a chuck arm out of supporting engagement with the free end of a mandrel when the mandrel arrives at a wound roll unloading station and for swinging the chuck arm back into supporting engagement with the free end of the mandrel just before the mandrel leaves a core loading station.

BACKGROUND OF THE INVENTION

In automatic web rewinding machines of the type to which this invention relates, a number of core supporting mandrels—typically six—are mounted on an indexingly rotatable turret. The mandrels extend parallel to the horizontal axis about which the turret rotates, and they are spaced at equal distances from the turret axis and at uniform intervals around that axis. A six-mandrel turret moves through one-sixth of a revolution at each of its indexing movements, and hence it carries each mandrel in turn to each of six successive stations, with a period of dwell at each station.

In this case, one station—which could be considered the first one—is a loading station at which a length of core stock is slid axially onto the mandrel. At the next station the core stock is slitted into shorter lengths, each corresponding to the width of an individual roll, and glue is applied to the core. At the third station the mandrel is brought up to winding speed, and as the mandrel is moving from the third to the fourth station the web is attached to the glued core on the mandrel, for the beginning of the winding operation. Winding continues while the mandrel is at the fourth station, and as it moves out of that station the web is cut through across its width to sever it from the wound roll and give it a new leading edge that is attached to a new core on a mandrel moving into the winding station. At the fifth station the rotation of the mandrel is decelerated to a stop, and at the sixth station the wound core or "log" is stripped off of the mandrel. The mandrel then moves to the first station for a repetition of the cycle.

The turret by which the mandrels are carried comprises a spider which is mounted for rotation on a coaxial shaft that projects a substantial distance in one direction from the spider. The mandrels have rotating connections with the spider, and they project from it in the same direction as the turret shaft. The rotating connection of each mandrel with the spider must provide for cantilevered support of the mandrel because, when the mandrel is at the core loading station and the unloading station, its end remote from the spider has to be accessible to allow cores to be moved axially onto and off of it. But the mandrels tend to be rather heavy and very long—72 in. to 96 in. is typical—and therefore their free ends should be supported whenever possible, and certainly during winding.

To provide for support of the free ends of the mandrels, there is conventionally an assembly of supporting arms or chucks on the end portion of the turret shaft that is remote from the spider. This assembly, which is constrained to indexing rotation with the spider, comprises a chuck arm for each mandrel. Each chuck arm is swingable about an axis which is near the turret axis and transverse thereto, between a substantially radially extending closed position in which the free end of the chuck arm supportingly engages the free end portion of its mandrel and an open position in which the chuck arm is disengaged from its mandrel and is disposed in a more or less axial orientation alongside the turret shaft. Each chuck arm is operated automatically so that it is in its open position during loading and unloading of the mandrel and is in its closed position at least from the time the mandrel moves into the gluing and core slitting station until it moves out of the deceleration station.

The heretofore conventional mechanism for actuating the mandrel supporting chuck arms in an automatic web rewinder is illustrated in U.S. Pat. No. 2,769,600, to Kwitek et al. It comprised a barrel cam that was fixed to the machine frame adjacent to the free ends of the mandrels, and a lever and link arrangement for each chuck arm, each such arrangement being carried by the turret for rotation therewith and having a cam follower roller that rode in a groove in the periphery of the stationary barrel cam. Each chuck arm was thus actuated at appropriate times in consequence of indexing movement of the turret. The shape of the cam groove was said to be such that the chuck arms moved into engagement with their respective mandrels when the latter were "generally adjacent the glue applicator wheels" and retracted when the mandrels moved "from the web winding position."

Stripping of wound rolls off of a mandrel is conventionally accomplished by means of a pusher that engages the log at only one side of the mandrel and thus tends to impose a lateral force upon the cantilevered mandrel that can set it into a vibration which may be aggravated by the indexing movement that follows unloading. With the mandrel unsupported at the loading station, its free end often wobbled so severely that a core could not be run onto it with automatic core loading equipment.

With heretofore conventional machines, failure to load a core created a danger that the mandrel itself would be coated with glue at the gluing station, necessitating a lengthy shutdown of the machine for cleaning. When the operator saw that an unloaded core was moving out of the loading station, he could and did stop the machine, but because of the nature of the chuck arm actuating mechanism, there was no way to retract the chuck arm engaged with the empty mandrel, to permit manual loading of a core onto it axially. The conventional solution to this problem was to slit a core along its length and push it laterally onto the mandrel, to protect the mandrel from glue; and then, at the conclusion of the winding cycle, discard the individual rolls wound onto that slitted core.

The Kwitek et al patent recognizes that wobble of an unsupported mandrel end could cause a chuck arm to fail to engage the mandrel properly. It discloses a U-shaped member on each chuck arm, intended to preliminarily engage the mandrel during closing movement of the chuck arm and steady the mandrel sufficiently to enable its conical free end to be received in the bearing socket in the chuck arm. Unfortunately, this expedient was not always successful in practice, and when the wobbling mandrel failed to enter the chuck arm socket, the cam operated chuck arm mechanism exerted as much force as the indexing mechanism could impose, with inevitable bending or breakage of the link and lever elements that translated cam follower motion into swinging motion of the chuck arm. Repair of such damage was difficult and time consuming.

One expedient that has been used to prevent damage to the chuck arm actuating mechanism was to mount the barrel cam for limited axial motion and pneumatically bias it towards one limit of such motion. When a chuck arm failed to close properly, the reaction force that was imposed upon the cam moved it against its bias to a position at which it actuated an emergency stop switch that shut down the machine until the operator could investigate and correct the malfunction. However, this emergency shut-down arrangement, like the U-shaped mandrel damping member disclosed by Kwitek et al, merely relieved some of the effects of the problem rather than solving the problem itself. For example, it still did not permit axial loading of a core onto an empty mandrel that had moved out of the loading station.

One side effect of the prior mechanism for actuating the chuck arm is worth noting, although it probably received little recognition. The primary drive for chuck arm actuation was essentially the indexing mechanism for the turret, through which all forces needed for such actuation had to be delivered. The chuck arm mechanism thus contributed to the load on the indexing mechanism (especially upon failure of a chuck arm to close properly) and in turn increased the wear on the indexing mechanism with corresponding decrease in indexing accuracy.

SUMMARY OF THE INVENTION

The general object of the present invention is to provide, in an automatic web rewinding machine of the character described, an automatic mandrel chucking mechanism which does not employ force derived from turret indexing to effect chuck arm actuation, and which moves the chuck arms to and from their mandrel supporting positions only during periods of dwell, to thus minimize the likelihood of mandrel vibration at the time chuck arm closing occurs, said mechanism being nevertheless arranged to allow a chuck arm to be manually controlled for movement to its open position in any position of the turret, so that a core can be axially loaded onto an empty mandrel or a defective core or roll can be axially stripped off of the mandrel.

Another and more specific object of the invention is to provide automatic mandrel chucking mechanism of the character described wherein there is provision for steadying a mandrel that is at the loading station, notwithstanding that its supporting chuck arm is not engaged with it, so that a core can be reliably slid onto the mandrel by means of an automatic core loading mechanism and the chuck arm for the mandrel can be quickly and reliably brought to its closed, mandrel-supporting position.

Another specific object of the invention is to provide an automatic chuck arm mechanism which is so arranged as to be inherently immune to damage and breakage in the event a mandrel is bent or otherwise has its free end out of alignment with the bearing socket in its chuck arm.

It is also a specific object of this invention to provide an automatic chuck arm actuating system in an automatic web rewinding machine, so arranged that successful loading of a core onto a mandrel at the core loading station is a condition for movement of the mandrel out of the core loading station.

In general, these objects of the invention are achieved in an automatic web rewinding machine comprising a turret rotatable about an axis, at least one core supporting mandrel that has at one of its ends a rotatable connection with the turret that provides for cantilevered support of the mandrel in laterally spaced parallel relation to said axis, and an indexing mechanism that imparts indexing rotation to the turret. Such indexing rotation carries the mandrel to each of a succession of fixed stations, at each of which the mandrel dwells for a time. One of said stations is a loading station whereat a tubular core is loaded onto the mandrel, and another is an unloading station at which a wound core is removed from the mandrel and from which the mandrel moves to the loading station. A chuck arm is constrained to rotate with the turret but is moveable relative to it between a closed position in which the chuck arm supportingly engages the other end of the mandrel and an open position in which the chuck arm is disengaged from the mandrel to permit cores to be moved axially onto and off of it. The web rewinding machine of this invention is characterized by: chuck arm actuating means rotatable with the turret, said chuck arm actuating means being responsive to a closing input to cause the chuck arm to assume its closed position and being responsive to an opening input to cause the chuck arm to assume its open position; unloading station input means comprising a position sensor responsive to position of the turret and a first input element at a location fixed in relation to the stations, said input element being operatively associated with said position sensor and being located and arranged to deliver an opening input to said chuck arm actuating means when the mandrel is established at the unloading station; a core sensor arranged to produce an output when a core is properly loaded onto a mandrel at the loading station; and a second input element operatively associated with said core sensor and located in spaced relation to said first input element, said second input element being arranged to deliver a closing input to the chuck arm actuating means in response to an output from said core sensor issued when the mandrel is at the loading station.

In a preferred embodiment of the invention said chuck arm actuating means comprises a control element having a cam follower which is movable in directions substantially parallel to said axis and which is yieldingly biased in one of said directions to one of a pair of defined positions; said first input element comprises a first movable cam member which is located to be engaged by said cam follower when the mandrel is at the unloading station and which moves in the other of said directions to produce an opening input; and said second input element comprises a second movable cam member which is located to be engaged by said cam follower when the mandrel is at the loading station and which moves in said one direction to produce a closing input.

Further, in the preferred embodiment there is a fixed cam member located between said first and said second movable cam members and arranged to be engaged by said cam follower as the mandrel is moving from the unloading station to the loading station, to then maintain said cam follower at the other of its said positions.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
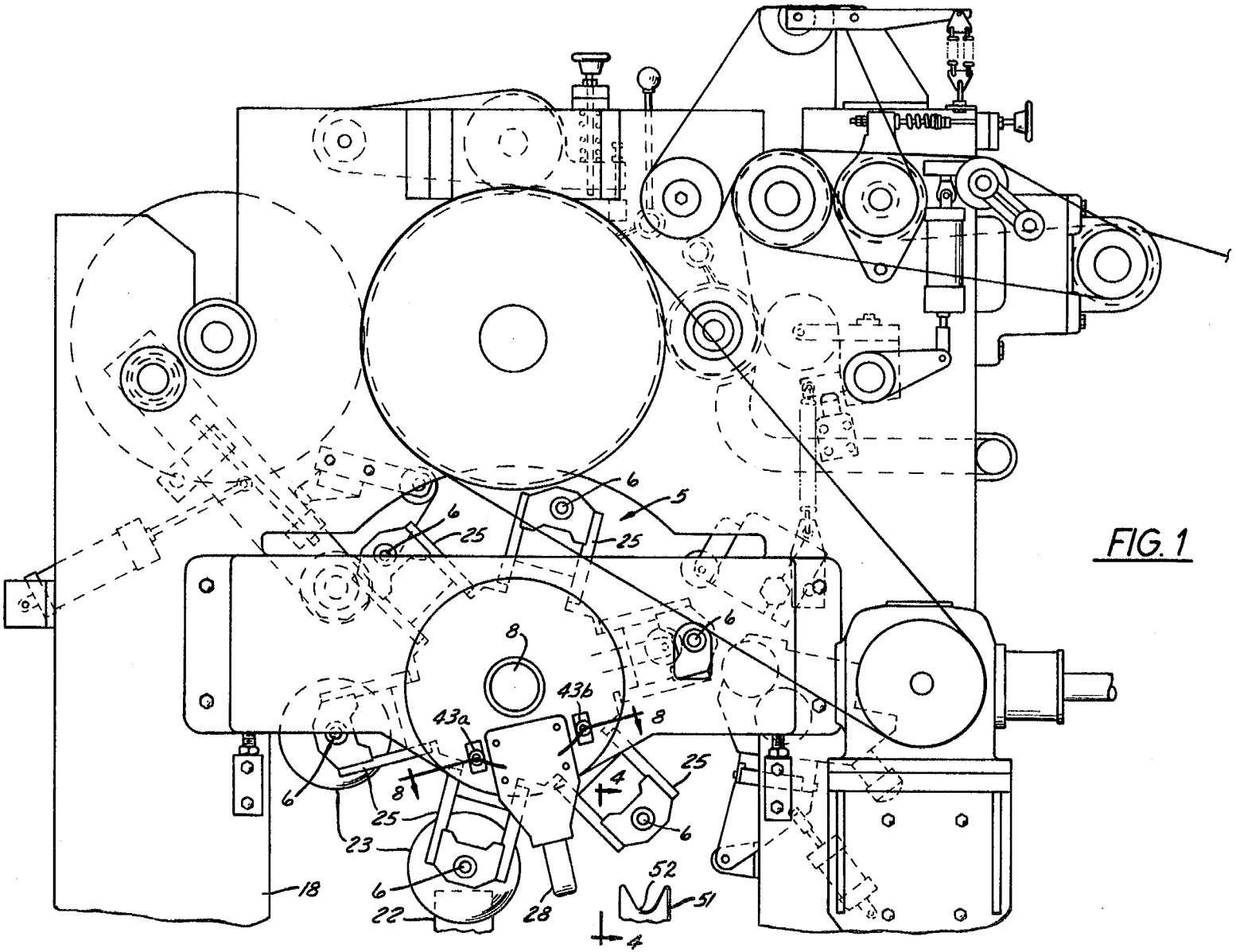
FIG. 1 is a view in elevation of the winding machine of this invention, as seen from the end of its turret at which the mandrel supporting chuck arms are located.

Referring now to the accompanying drawings, the numeral 5 designates generally the turret of an automatic web rewinding machine, by which a plurality of rotatable core supporting mandrels 6 are carried for indexing orbital motion as well as for rotation about their own respective axes. The turret comprises a spider 7 by which the mandrels 6 are carried and a shaft 8 by which the spider 7 is supported for rotation. The turret shaft 8 projects a substantial distance in one direction from the spider, and the mandrels 6 project from the spider 7 a somewhat smaller distance in the same direction. Since the rotatable connection between the spider 7 and each of the long, relatively heavy mandrels 6 is near one end of the mandrel, and the other end of the mandrel will be unsupported at times, the spider carries two axially spaced apart bearings 9 and 10 for each mandrel, so that the cantilevered connection of the mandrel with the spider can, by itself, hold the mandrel reasonably steady. As is conventional, the mandrels 6 are equidistant from the axis of the turret 5 and are uniformly spaced around that axis.

The mandrels 6 can be driven for their rotation in any conventional manner, but in the particular arrangement here illustrated each mandrel is connected, at its end adjacent to the spider 7, with a coaxial clutch 12 that provides for a disengageable driving connection between the mandrel and a coaxial sheave 14. The sheave 14 is connected by means of a belt 15 with a pulley 16 that is rotatable on the turret shaft 8; and, in turn, a belt 17 drivingly connects the pulley 16 with a motor (not shown) which is at a fixed location relative to the frame 18 of the machine. The illustrated mandrel drive arrangement, which is suitable for the rewinding of both tensioned and untensioned webs, is fully described and explained in the copending U.S. patent application of Dale D. Leanna et al, Ser. No. 06/113,465, filed Jan. 21, 1980, which has a common assignee herewith and which contains much additional information about a machine for which the present invention is very suitable. Reference can therefore be made to said Leanna et al application for a complete disclosure of a preferred environment for the present invention, but it is to be understood that this invention is very readily and advantageously adaptable to other and more conventional web winding machines.

As brought out hereinabove, and as more fully explained in the Leanna et al application, the turret 5 is indexingly rotated (the indexing mechanism can be conventional and is therefore not shown) to carry each of the mandrels 6 to each of a succession of fixed stations, at each of which the mandrel dwells for a time during the performance of an operation distinctive to the particular station. The arrangement of the stations, the operation or operations performed at each, and the apparatus provided at the several stations for the performance of their functions are all generally known to those familiar with web rewinding machines, and therefore most of these details are not illustrated.

Figures 2, 3:
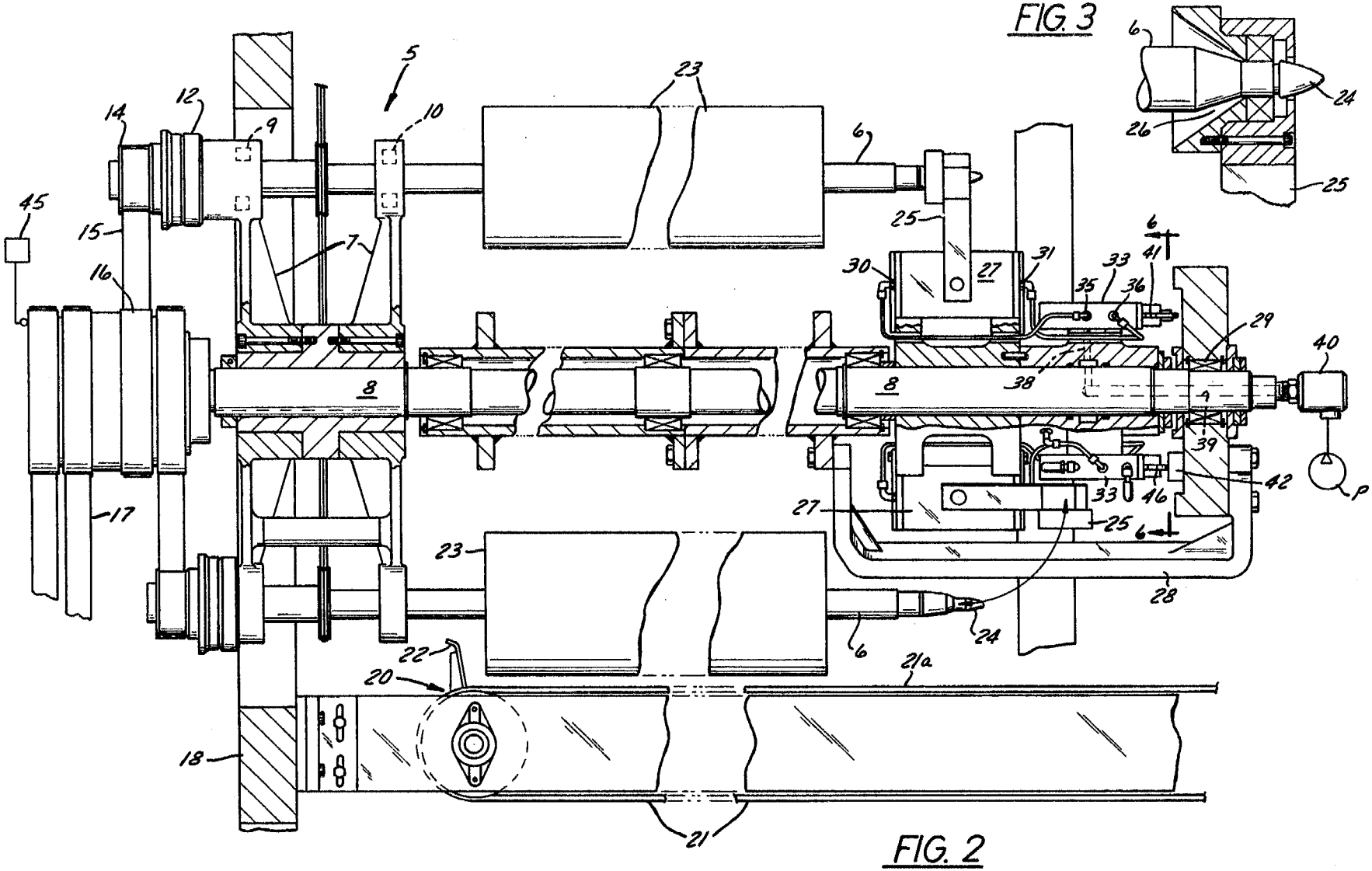
FIG. 2 is a view of the machine in longitudinal section, taken on a substantially vertical plane and showing mandrels at the unloading station and at the winding station.
FIG. 3 is a fragmentary view in section through one of the chuck arms, showing how it supportingly engages the free end portion of its mandrel when it is in its operative or closed position.

However, FIG. 2 depicts a generally conventional mandrel unloading mechanism 20 by which a wound log or set of individual rolls is stripped off of a mandrel at the unloading station. The unloading mechanism 20 comprises an endless belt 21 arranged to have a long straight stretch 21*a* which extends parallel to the mandrel 6 at the unloading station, at a small distance to one side of that mandrel. A pusher 22 is secured to the belt 21 and projects laterally therefrom to engage behind a log 23 and drive it off of the mandrel 6 as the pusher moves away from the spider 7 along the straight stretch 21*a*.

Figure 5:
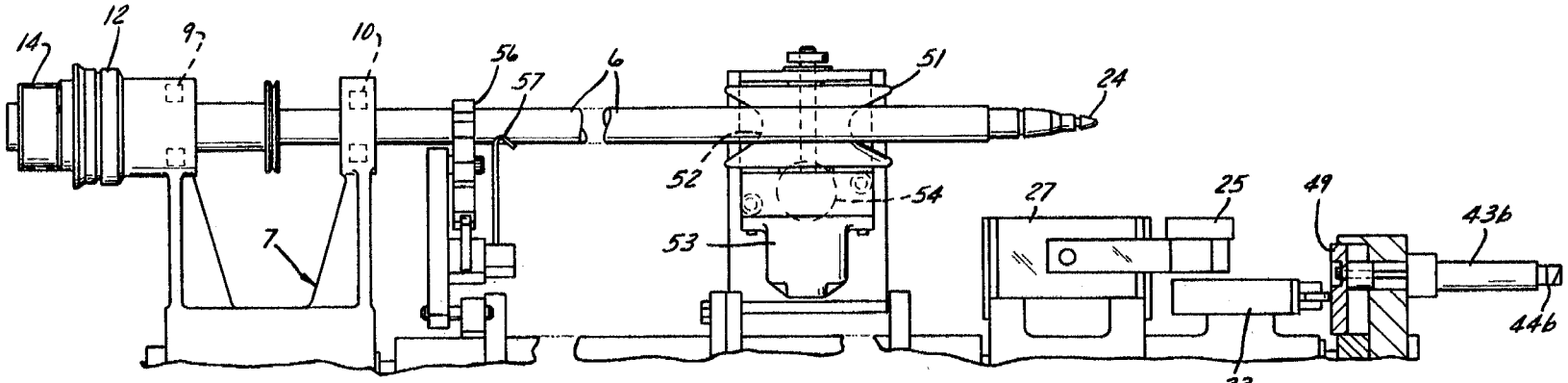
FIG. 5 is a fragmentary plan view showing a mandrel at the loading station in its relation to its chuck arm and the core loading wheel.
Figure 4:
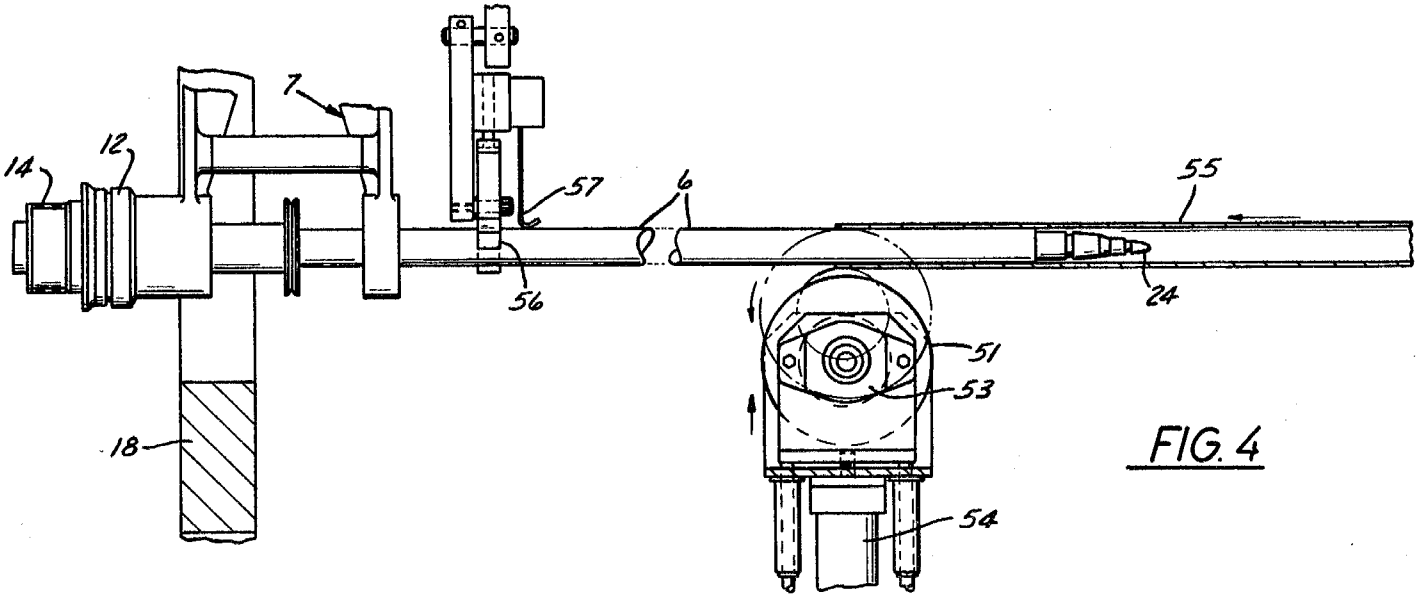
FIG. 4 is a fragmentary view in side elevation showing a mandrel at the core loading station in its relation to the core loading wheel and the core-presence sensor.
Figure 6:
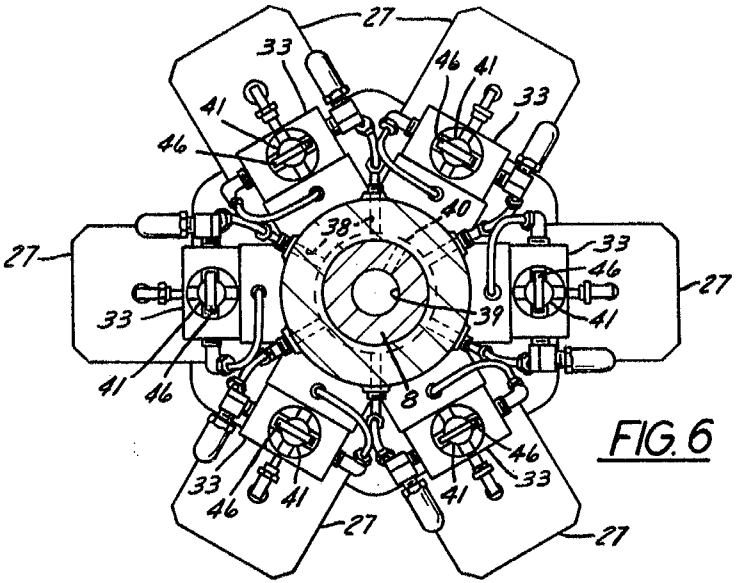
FIG. 6 is a view taken on the plane of the line 6—6 in FIG. 2.
Figure 7:
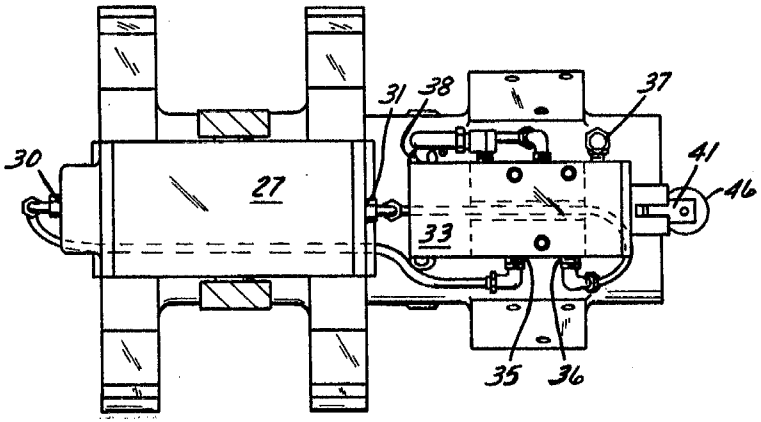
FIG. 7 is a view in elevation of the actuating means for one of the chuck arms, including the pneumatic rotary actuator and the two way valve that comprises a control element for the actuator.
Figure 8:
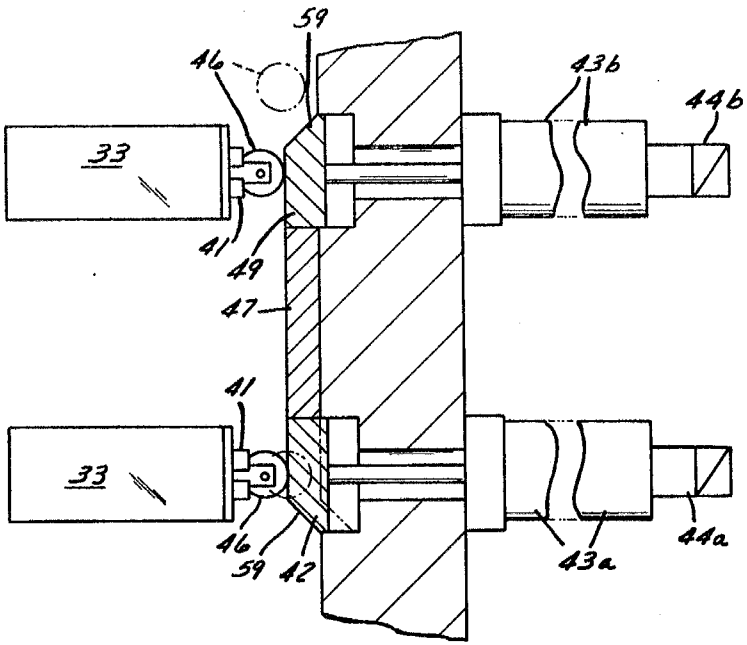
FIG. 8 is a more or less diagrammatic view in section of the cam members that comprise the input elements and the means for actuating the movable cam members, shown in their relationship to the two-position valves that comprise the control elements for the chuck arm actuators.

At the loading station, to which a mandrel directly passes from the unloading station and which is illustrated in FIGS. 4 and 5, a length of tubular core stock 55 from a supply thereof is advanced axially by known mechanism, to be loaded onto the mandrel. The mandrel has a conical or bullet-nose free end portion 24 to guide cores into coaxial relationship with it.

During both unloading and loading of a mandrel, its end that is remote from the spider 7 must be unsupported. But as the mandrel moves through the portion of its orbit that takes it from the loading station around to the unloading station, its free end portion is supported by means of a chuck arm 25 that is swingable to and from engagement with it.

There is of course a chuck arm 25 for each mandrel—in this case, six mandrels and six chuck arms—and the several chuck arms 25 are carried by the turret shaft 8 for indexing rotation with it and for swinging motion relative to it. Each chuck arm 25 is swingable about an axis which is near the axis of the turret shaft 8 and transverse thereto. Such swinging motion carries the chuck arm 25 between a closed operative position in which it supportingly engages the free end portion 24 of its mandrel and extends substantially radially to the turret shaft 8 and an open position in which the chuck arm is disengaged from its mandrel and extends alongside the turret shaft 8, substantially parallel to it. Each chuck arm 25, as is generally conventional, is substantially U-shaped, having a bight portion which is remote from the axis about which it swings and which comrpises a bearing socket 26 in which the conical end portion 24 of its mandrel is receivable. The swinging axis of each chuck arm is defined by a reversible pneumatic actuator 27 which is straddled by the chuck arm and which has its body secured to the turret shaft 8 to rotate therewith.

Each of the reversible pneumatic actuators 27 is of a known type having two ports 30, 31. When pressure air is fed into the port 30, the other port 31 serves as an exhaust port and the actuator swings its chuck arm 25 in the closing direction and holds it closed, whereas supply of pressure air to the port 31, with the port 30 serving as an exhaust outlet, opens the chuck arm and holds it open.

In accordance with the present invention, the pneumatic actuator 27 for each chuck arm 25 is so controlled that a chuck arm is not moved out of its closed mandrel-engaging position until its mandrel is established at the unloading station; and the chuck arm is returned to its closed or operative position during the period of dwell of the mandrel at the loading station, but only after an automatic check has been made to ensure that a core has been fully loaded onto the mandrel. As is conventional, the chuck arm 25 remains in its open position during indexing of the mandrel from the unloading station to the loading station so that the chuck arm can clear a fixed support 28 for the adjacent turret shaft bearing 29, which support is between the unloading and loading stations.

For each chuck arm actuator 27 there is a two-condition control element 33 which, in the preferred embodiment, comprises a four-port two-position valve having an axially slidable valve element. The two outlet ports 35, 36 of each control element 33 are respectively connected with the ports 30, 31 of its actuator 27; one of its other two ports, designated by 37, is open to the atmosphere as an exhaust outlet, and pressure air is fed to its fourth port 38. For such supply of pressure air, the turret shaft 8 is tubular at its end portion remote from the spider, and the bore 39 of this tubular portion serves as a pressure air chamber which is communicated through a generally conventional rotary pressure air connection 40 with a pressure air source P. Radially opening outlets in the tubular portion of shaft 8 provide for communication of the pressure air chamber 39 with the inlet port 38 of each control element 33.

The several control elements 33 are carried by the turret 5—and specifically by its shaft 8—for rotation therewith. The control elements 33 are spaced around the turret in correspondence with the circumferential spacing of the mandrels 6 with which they are respectively associated. In this case each control element 33 is radially in line with its associated mandrel 6 and axially in line with the actuator 27 for the chuck arm 25 of that mandrel, at the side of said actuator that is remote from the spider 7. The slidable valve element (not shown) of each control element 33 is actuated by an extensible and retractable plunger 41 that projects axially away from the spider 7 and comprises a cam follower, having a cam follower roller 46 on its outer end.

It will be seen that each rotary actuator 27, considered with its control element 33, comprises an actuating means for a chuck arm 25, whereby the chuck arm is moved to its closed or operative position in response to a closing input and moved to its open position in response to an opening input. In the illustrated case, an opening input effects retracting movement of the plunger 41 (in the axial direction towards the spider 7), and the plunger extends in response to a closing input. Preferably, the plunger 41 of each control element 33 is biased towards its extended condition, at which the associated actuator 27 is caused to swing its chuck arm 25 to the closed position and maintain it in that position. Hence, a manual or mechanical force by which the plunger 41 of a control element is retracted against its bias constitutes an opening input, while a subsequent release of the plunger constitutes a closing input. Thus the chuck arm 25 for any mandrel can be opened at any desired point in the mandrel orbit by manually delivering an opening input to the control element 33 associated with that chuck arm.

In the normal operation of the apparatus, the plunger 41 of the control element 33 for each mandrel remains extended as the mandrel moves into the unloading station, and an opening input is automatically delivered to the control element 33 when the mandrel is established at the unloading station. In this case the opening input is delivered by an input element 42 at the unloading station that comprises a cam segment mounted on the machine frame for back and forth movement in directions parallel to the turret axis. The cam segment 42 is moved to extended and retracted positions by a pneumatic cylinder **43*a* which is, in turn, controlled by a solenoid actuated valve 44*a*. As a mandrel moves into the loading station, the cam segment 42 is in its retracted position, and therefore the plunger 41 for that mandrel remains extended. When the turret is fully established in its dwell position, a sensor 45 that is responsive to turret position issues an output which can be employed to stop indexing motion of the turret and/or to effect energization of the solenoid actuated valve 44*a*. With the valve 44*a* open, the cylinder 43*a* moves the cam segment 42 towards the spider 7, to its extended position, and the cam segment 42 thus delivers an opening input to the control element 33 that causes opening of the chuck arm 25** for the mandrel at the unloading station.

The unloading mechanism 20 can be started as soon as the chuck arm 25 for the mandrel at the unloading station has reached its open position. Starting of the unloading mechanism can be coordinated with chuck arm opening in any of several obvious ways. For example, the start signal can be issued after a predetermined delay interval following the end of indexing motion. As another alternative, the unloading mechanism 20 can be stopped at the end of each unloading operation with its pusher 22 in such a position that, when it is restarted for the next operation, said pusher must move a substantial distance before coming into engagement with the log 23 to be stripped off of the mandrel; and in that case the unloading mechanism 20 can be started in operation simultaneously with delivery of the opening input to the control element 33 at the unloading station.

Once the moveable cam segment 42 at the unloading station has been moved to its extended operative position, it remains in that position until turret indexing has carried the mandrel out of the unloading station. Furthermore, as a mandrel moves away from the unloading station, and the plunger 41 of its associated control element moves off of the movable cam segment 42, that plunger moves directly onto a fixed cam segment 47 which is flush with the extended movable cam segment 42 and which thus maintains the plunger 41 in its retracted condition. The chuck arm 25 for the mandrel moving from the unloading station to the loading station thus remains open so that it can clear the fixed turret bearing support 28. After a plunger 41 has passed onto the fixed cam segment 47, the movable cam segment 42 at the unloading station is retracted, in preparation for movement of the next mandrel into the unloading station.

As a plunger 41 is in the final stage of indexing movement into the loading station, it passes off of the fixed cam segment 47 and onto a second movable cam segment 49 which comprises an input element essentially similar to the input element at the unloading station. Thus, the second movable cam segment 49 is moved to extended and retracted conditions by means of a pneumatic actuator **43*b* that is controlled by a solenoid actuated valve 44*b*. During indexing movement, at or about the time that the movable cam segment 42 at the unloading station is retracted, the movable cam segment 49 at the loading station is extended, to be flush with the fixed cam segment 47. Hence, as a mandrel moves into the loading station, its chuck arm 25 remains open, to be out of the way as a core is loaded axially onto the mandrel. The signal or signals for retraction of the first movable cam segment 42 and extension of the second movable cam segment 49** can emanate from a program control device (not shown) which also controls the timing of other functions of the machine, as explained in the Leanna et al application.

For reasons explained above, a mandrel 6 may be in substantial vibration when it arrives at the loading station, but according to the present invention the wobbling of its free end that is due to such vibration is damped by means of a core loading wheel 51 at the loading station. As the mandrel is moving into and out of the loading station, the core loading wheel 51 is in a lowered position, well clear of the mandrel; but after the mandrel is established at the loading station the core loading wheel moves up and engages the mandrel a small distance from its conical end portion 24.

The core loading wheel 51 has its axis horizontal and transverse to that of the mandrel; and it has a circumferentially grooved periphery, somewhat like that of a sheave, but with a groove 52 of such profile that a mandrel can be rather closely received therein. The wheel 51 and a small hydraulic motor 53 that rotatably drives it are mounted for up and down movement on a pneumatic cylinder jack 54 which serves as an elevator. As just pointed out, the cylinder jack 54 is retracted when a mandrel enters the loading station, so that the core loading wheel 51 is spaced from the mandrel; but when the mandrel is established at the loading station, the cylinder jack 54 extends to engage the wheel 51 against the mandrel. At the same time that the jack 54 extends, the hydraulic motor 53 begins to drive the wheel 51 in rotation.

A core 55 is started onto the mandrel at the loading station by means of core loading apparatus which is not here shown and which can be generally conventional. After the core 55 has run onto the mandrel a little distance, the core is engaged by the rotating core loading wheel 51, which initially cooperates with the core loading apparatus in moving the core onto the mandrel, but which takes over the propulsion of the core in the last part of its movement onto the mandrel.

When a core 55 is properly positioned on the mandrel, its front end engages an abutment 56 that is located near the spider 7. After it engages the abutment 56, the core cannot be advanced any farther by the rotating core loading wheel 51, which then merely slips relative to the core. At about the same time that the core engages the abutment 56, its front end portion moves under a spring arm 57 that comprises a core detector. The spring arm 57 has a free end portion that is biased towards contacting engagement with a mandrel 6 at the loading station, and a properly loaded core 55 intervenes between the spring arm 57 and the mandrel 6 to break the contact between them and thus open an electric signal circuit through the spring arm 57. Interruption of this circuit, comprising an output signifying core presence, can cause rotation of the core loading wheel 51 to be stopped and the pneumatic jack 54 to be retracted. The core-present signal can also be issued to the program control device or other synchronizing mechanism for the machine, and its issuance is in any case a condition—or the condition—for retraction of the movable cam segment 49 at the loading station. Such cam segment retraction, as pointed out above, constitutes a closing input to the control element for the chuck arm of the newly-loaded mandrel, causing that chuck arm to be swung back into engagement with its mandrel. Thus the chuck arm 25 is closed only if and when a core is present on the mandrel at the loading station, and before the mandrel begins to move out of that station.

Since the chuck arm 25 moves to its closed position at a time when the mandrel is stationary, and after the mandrel has been subjected to vibration damping, there will normally be no likelihood that the conical end portion 24 of the mandrel will fail to seat in the bearing socket 26 of the chuck arm. However, in the event of such a failure, the pneumatic actuator 27 for the chuck arm will merely stop short of its limit position at which the chuck arm is closed, and no damage can result because the chuck arm will be urged against the stationary mandrel under yielding pneumatic pressure.

Preferably each of the two movable cam segments 42, 49 has a beveled or inclined ramp portion 59 along its edge remote from the other, so that in the event of an electric power failure, which would leave those cam segments in their extended conditions, the cam follower roller 46 can move easily onto either movable cam segment as the turret is manually indexed in either direction.

From the foregoing description taken with the accompanying drawings, it will be apparent that this invention provides automatic means for actuating the mandrel supporting chuck arms of an automatic web rewinding machine, so arranged that opening and closing of the chuck arms occur at times when the turret is not in indexing motion and the chuck arm for a mandrel can be readily opened at any point in the mandrel orbit. It will also be apparent that the invention practically eliminates the possibility that a mandrel will move out of the loading station without a properly loaded core on it and that a chuck arm actuator will be damaged by failure of the chuck arm to mate with the end of its mandrel during closing.

What is claimed as the invention is:

1. An automatic web rewinding machine comprising a turret rotatable about an axis, a core supporting mandrel having at one of its ends a rotatable connection with the turret that provides for cantilevered support of the mandrel in laterally spaced parallel relation to said axis, an indexing mechanism that imparts indexing rotation to the turret whereby the mandrel is carried to each in turn of a succession of fixed stations, at each of which the mandrel dwells for a time, one of said stations being a loading station whereat a tubular core is loaded onto the mandrel and another being an unloading station at which a wound core is removed from the mandrel and from which the mandrel moves to the loading station, and a chuck arm constrained to rotate with the turret but movable relative thereto between a closed position in which the chuck arm supportingly engages the other end of the mandrel and an open position in which the chuck arm is disengaged from the mandrel to permit cores to be moved axially onto and off of the mandrel, said web rewinding machine being characterized by:

A. chuck arm actuating means rotatable with the turret, said chuck arm actuating means being responsive to a closing input to cause the chuck arm to assume its closed position and being responsive to an opening input to cause the chuck arm to assume its open position;

B. unloading station input means comprising (1) a position sensor responsive to position of the turret and (2) a first input element at a location on the machine that is fixed in relation to said stations, said input element being operatively associated with said position sensor and being located and arranged to deliver an opening input to said chuck arm actuating means when the mandrel is established at the unloading station;

C. a core detector arranged to produce an output when a core is properly loaded onto a mandrel at the loading station; and D. a second input element operatively associated with said core detector and located in spaced relation to said first input element, said second input element being arranged to deliver a closing input to the chuck arm actuating means in response to an output from said core detector issued when the mandrel is at the loading station.

2. The automatic web rewinding machine of claim 1, further characterized by:

(1) said chuck arm actuating means comprising a control element having a cam follower which is movable in directions substantially parallel to said axis and which is yieldingly biased in one of said directions to one of a pair of defined positions;

(2) said first input element comprising a first movable cam member which is located to be engaged by said cam follower when the mandrel is at the unloading station and which moves in the other of said directions to produce an opening input; and (3) said second input element comprising a second movable cam member which is located to be engaged by said cam follower when the mandrel is at the loading station and which moves in said one direction to produce a closing input.

3. The automatic web rewinding machine of claim 2, further characterized by:

(4) a fixed cam member located between said first and second movable cam members and arranged to be engaged by said cam follower as the mandrel is moving from the unloading station to the loading station, to then maintain said cam follower at the other of its said positions.

4. An automatic web rewinding machine comprising a turret rotatable about an axis, a core supporting mandrel having at one of its ends a rotatable connection with the turret that provides for cantilevered support of the mandrel in laterally spaced, parallel relation to said axis, an indexing mechanism that imparts indexing rotation to the turret whereby the mandrel is carried to each in turn of a succession of fixed stations, at each of which the mandrel dwells for a time, one of said stations being a loading station whereat a tubular core is loaded onto the mandrel and another being an unloading station at which a wound core is removed from the mandrel and from which the mandrel moves to the loading station, and a chuck arm constrained to rotate with the turret but movable relative thereto between a closed position in which the chuck arm supportingly engages the other end of the mandrel and an open position in which the chuck arm is disengaged from the mandrel to permit cores to be moved axially onto and off of the mandrel, said web rewinding machine being characterized by:

A. a reversible actuator for the chuck arm, constrained to rotate with the turret and by which the chuck arm can be alternatively and selectively moved to and maintained in each of said open and said closed positions;

B. a two-condition control element constrained to rotate with the turret and operatively associated with said actuator, said control element being responsive to an opening input to cause the actuator to move the chuck arm to its open position and being responsive to a closing input to cause the actuator to move the chuck arm to its closed position;

C. means for at all times communicating said actuator, through the control element, with a source of energization for the actuator that is outside the turret, the last mentioned means comprising a rotary connection coaxial with the turret;

D. first input means at a location fixed with respect to said stations and cooperable with said control element when the mandrel is in dwell at the unloading station for issuing an opening input to said control element; and E. second input means in spaced relation to said first input means and cooperable with said control element when the mandrel is in dwell at the loading station for issuing a closing input to said control element.

5. The automatic web rewinding machine of claim 4, further characterized by:

(1) said first input means comprising a sensor responsive to the position of the turret and being arranged to issue an opening input in response to establishment of said mandrel at the unloading station;

(2) said second input means comprising a core presence detector responsive to the presence on the mandrel of a properly loaded core and being arranged to issue a closing input when a core is properly loaded onto the mandrel.

6. The automatic web rewinding machine of claim 4 wherein said turret comprises a spider to which the mandrel has its rotatable connection and a shaft coaxial with the spider and extending therefrom in the same direction as the mandrel whereby the spider is supported for rotation, further characterized by:

(1) said shaft having a hollow portion at its end remote from the spider which provides a pressure air chamber;

(2) said rotary connection being arranged to communicate said pressure air chamber with a source of air under pressure; and (3) said two-condition control element comprising a two-position pneumatic valve having a pressure air inlet communicated with said pressure air chamber.

7. An automatic web rewinding machine comprising a turret rotatable about an axis, a core supporting mandrel having at one of its ends a rotatable connection with the turret that provides for cantilevered support of the mandrel in laterally spaced parallel relation to the turret axis, an indexing mechanism that imparts indexing rotation to the turret whereby the mandrel is carried to each of a succession of fixed stations, at each of which the mandrel dwells for a time, one of said stations being a loading station whereat a tubular core is loaded onto the mandrel and another being an unloading station at which a wound core is removed from the mandrel and from which the mandrel moves to the loading station, a chuck arm rotatable with the turret and movable relative to the turret to and from an operative position of supporting engagement with the other end of the mandrel, and an actuator for said chuck arm whereby the chuck arm is moved out of said operative position just before a wound core is removed from the mandrel and is moved back to said position after a core is loaded onto the mandrel at the loading station, said web rewinding machine being characterized by:

A. means for maintaining said chuck arm out of its operative position as the mandrel is carried from the unloading station to the loading station;

B. a core loading wheel having its periphery formed as a radially outwardly opening groove in which a core is partway receivable;

C. a carrier at the loading station by which said core loading wheel is carried.

(1) for rotation about a substantially horizontal axis transverse to the length of the mandrel and (2) for bodily up and down motion to and from a position of supporting engagement with the mandrel near the other end thereof; and D. means for rotatably driving said core loading wheel so that a tubular core that is partially loaded onto the mandrel and is confined between the mandrel and said wheel can be driven axially all the way onto the mandrel by friction of the rotating wheel against the core.

8. The automatic web rewinding machine of claim 7, further characterized by:

E. means defining an abutment against which an end of a tubular core engages when the core is properly loaded onto the mandrel, to prevent further axial movement of the core in response to the force exerted thereon by the rotating core loading wheel; and F. a detector near said abutment, responsive to presence on the mandrel of a core that is substantially engaged with said abutment to issue a core-present output which terminates rotation of said wheel and causes said carrier to move the wheel away from its said position of supporting engagement with the mandrel.

9. The automatic web rewinding machine of claim 8, wherein said actuator for the chuck arm causes the latter to move to its operative position in response to a closing input, further characterized by:

G. an input element at a location that is fixed with respect to said stations, said input element being operatively associated with said detector and cooperable with said actuator when said mandrel is at the loading station to issue a closing input to said actuator in response to a core-present output.

10. The automatic web rewinding machine of claim 9, wherein said actuator for the chuck arm causes the latter to move to an open position, spaced from the mandrel, in response to an opening input, further characterized by:

H. a turret position sensor by which a turret position output is issued when the mandrel is established at the unloading station; and I. a second input element at a location that is fixed with respect to said stations, said second input element being operatively associated with said sensor and cooperable with said actuator when the mandrel is at the unloading station to issue an opening input in response to a turret position output.

* * * * *